United States Patent [19]

Schibbye et al.

[11] Patent Number: 4,460,322

[45] Date of Patent: Jul. 17, 1984

[54] ROTORS FOR A ROTARY SCREW MACHINE

[75] Inventors: Lauritz B. Schibbye, Saltsjö-Duvnäs; Sture Fredlund, Vällingby, both of Sweden

[73] Assignee: Sullair Technology AB, Stockholm, Sweden

[21] Appl. No.: 452,394

[22] Filed: Dec. 22, 1982

[30] Foreign Application Priority Data

Dec. 22, 1981 [SE] Sweden ..... 8107699

[51] Int. Cl.[3] ..... F01C 1/16; F04C 2/00

[52] U.S. Cl. ..... 418/201

[58] Field of Search ..... 418/150, 201

[56] References Cited

U.S. PATENT DOCUMENTS

| | | | |
|---|---|---|---|
| 2,174,522 | 10/1939 | Lysholm | 418/201 |
| 2,622,787 | 12/1952 | Nilsson | 418/117 |
| 3,245,612 | 4/1966 | Nilsson et al. | 418/201 |
| 3,414,189 | 12/1968 | Persson | 418/201 |
| 3,423,017 | 1/1969 | Schibbye | 418/116 |
| 3,787,154 | 1/1974 | Edstrom | 418/201 |
| 4,140,445 | 2/1979 | Schibbye | 418/201 |
| 4,412,796 | 11/1983 | Bowman | 418/201 |

OTHER PUBLICATIONS

Marks, *Standard Handbook for Mechanical Engineers*, McGraw-Hill, New York, 1967, pp. 2-52, 53.

*Primary Examiner*—Leonard E. Smith

*Assistant Examiner*—Jane E. Obee

*Attorney, Agent, or Firm*—Wood, Dalton, Phillips, Mason & Rowe

[57] ABSTRACT

The invention relates to the design of the profiles of two meshing rotors, which are provided with helical lands and intervening grooves and adapted for rotation around parallel axes in a working space in a rotary screw machine, where one groove in one rotor (female rotor 1) co-operates with a corresponding land on a second rotor (male rotor 2), so that a chevron shaped chamber is formed by the flanks of the groove and the land, with the open legs of the chamber ending at the high-pressure end of the machine. The flank profiles according to the invention are designed so that the torque acting on the female rotor by the gas forces in the machine is 17-19.5%, preferably about 18.5%, of the corresponding torque on the male rotor, and that the blow hole area formed hereby at the high-pressure side of the rotor mesh does not exceed a value corresponding to 25 $mm^2$ per liter volume of the chevron shaped chamber when this chamber has its maximum volume, calculated for a male rotor diameter of 100 mm, a male rotor length of 150 mm and a wrap angle of the male rotor of 300°. According to an embodiment, the groove flanks of the female rotor are designed so that they include a leading groove flank portion, which follows an elliptic curve, and the land flanks of the male rotor are designed so that they include a leading land flank portion, which is line-generated by the elliptic groove flank portion of the female rotor.

26 Claims, 7 Drawing Figures

ROTORS FOR A ROTARY SCREW MACHINE

This invention relates to a rotary screw machine especially working as a compressor and, more precisely, to the profile of the rotors meshing in such a machine.

The rotors in rotary screw machines are provided with helical lands and intervening grooves and are adapted for rotation around parallel axes in a working space in the machine. One of the rotors is of female rotor type and so designed that a major portion of each groove is located inside the pitch circle of the female rotor, and a minor portion of each groove is located outside this pitch circle. The second rotor is of male rotor type and so designed that a major portion of each land is located outside the pitch circle of the male rotor, and a minor portion of each land is located inside this pitch circle.

During the last fifty years, a plurality of patents relating to different inventions of rotor profiles for rotary screw machines have been granted. A report on the basically most important ones of these patents is included, for example, in the patent application SE 344,615, which then concludes to propose a rotor profile stated to be optimum for a rotary screw machine. It was found possible, however, according to subsequent calculations and tests, to additionally and essentially improve the rotor profile, as will be apparent from the description as follows.

As appears from the aforesaid patent application, the object of previous rotor profile inventions has been to reduce the leakage in the working space of the rotary screw machine by various configurations of the flanks of the rotor profiles. It was tried to bring about, firstly, a short length of the sealing line in the rotor mesh and hereby a small leakage from the high-pressure side to the low-pressure side and consequently a high volumetric efficiency, and, secondly, a small so-called blow hole, which yields a small thread to thread leakage during the internal compression period, i.e. during the period of the operation process closed from the inlet and outlet ports of the machine, and thereby a reduction of the power consumption of the compressor. In the descriptive part of the aforesaid application it also is stated, that the torque of the female rotor is affected by the design of the rotor profiles, in such a manner, that this torque can be positive or negative. It is alleged that a positive female rotor torque implies the advantage, that unidirectional axial forces are obtained in both rotors, resulting in high mechanical reliability and high volumetric efficiency. Heretofore, however, in connection with designing the rotor profiles for the screw machine, the fact has been disregarded that there is a relation between the size of the aforesaid blow hole and the size of the positive torque of the female rotor, which relation is essential for the adiabatic efficiency of the machine. The fact is, when it is desired to design the profile so that the torque of the female rotor is increased, which, as will be described below, is necessary, up to a certain level, for obtaining a high adiabatic efficency, this can in principle not be effected without simultaneously obtaining a certain increase in size of the blow hole. These two interacting rotor profile characteristics, viz. female rotor torque and blow hole, thus, counteract each other in respect of the adiabatic efficiency in such a manner, that an increased female rotor torque results in an increasing adiabatic efficiency, while an increase in the size of the blow hole area resulting from the increasing female rotor torque yields a decreasing adiabatic efficiency. In other words, when designing the rotor profile there is an optimum relation between these two characteristics as regards the adiabatic efficiency.

One of the objects of the present invention is to achieve a rotor profile, which meets this optimum relation in order to bring about a rotary screw machine having an adiabatic efficiency exceeding what has been obtained with heretofore known profiles.

In conventional designs of rotor profiles the dominating idea in most cases has been to achieve, in addition to the shortest possible sealing line length in the rotor mesh, also the smallest possible blow hole area. It was tried, on the other hand, to design the profile so as to be favourable from a manufacturing aspect, i.e. by means of available manufacturing methods and machines to be able to produce rotors as accurate and inexpensive as possible. As regards the torque of the female rotor, however, its effect on the adiabatic efficiency has been completely overlooked. As a result thereof, substantial negative torques of the female rotor were obtained, especially at certain profile configurations, and these configurations have also proved to yield low adiabatic efficiencies. It was, however, not understood heretofore that these low efficiencies were caused by the female rotor torque characteristic. First after extensive investigations and evaluations of a large number of test series with different profile designs and many theoretical calculations we have succeeded in proving the relationship between female rotor torque and adiabatic efficiency.

The rotor profile shown, for example, in the U.S. Pat. No. 174,522 was the first developed asymmetric profile. According to the descriptive part in this parent the primary object of this profile was to substantially reduce the leakage areas between the different compression spaces in a screw compressor, compared to at that time known profiles. This profile, thus, had one of the flanks entirely point-generated from its root to its top, which implies that the blow hole area was entirely eliminated. As the other flank of the profile was designed to follow a circular arc with its centre at the pitch circle, a shortened length of the sealing line was obtained on this flank side. The resulting profile combination, however, yielded a very high negative torque of the female rotor. At the lobe combination 4+6, for example, and the depth of thread 18%, this negative female torque was of the magnitude 27% of the input torque to the compressor. In the descriptive part, however, nothing is mentioned about the distribution of the torque between the male and female rotors. At tests ran on compressors having rotors manufactured according to this patent profile design, it was not understood why the adiabatic efficiency was lower than expected. The reason actually was the large dynamic losses caused by the unfavourable torque distribution between the rotors in a way as will be clarified later on in this description.

The next step in the development of rotor profiles for screw compressors was the symmetrically circular profile disclosed, for example, in the U.S. Pat. No. 2,622,787. According to the descriptive part in this patent the efficiency should, in spite of a larger leakage obtained by adding a blow hole area, compared to the profile described above, be improved partly because of a further shortening by about 12% of the length of the sealing line in the rotor mesh, partly due to the elimination of the so-called trapped pockets at the rotor end faces caused by the asymmetric profile design and finally because of the introduction of sealing strips at the tops of the rotor lobes. The increase in efficiency which could have been expected by this change in profile, compared to the afore-described asymmetric profile should have been relatively marginal, if any, in view of the above mentioned rather limited improvements, when considering the relatively large blow hole, which was obtained simultaneously. The increase in efficiency however actually was substantial. The reason was believed to be found in the symmetric profile design, which by its simpler configuration was easier to manufacture by methods available at that time, whereby it was possible to achieve a better rotor quality, i.e. smaller clearance in the rotor mesh. The real reason, however, of this surprisingly large improvement was substantially the fact that the large negative torque of the female rotor had been eliminated and, instead, a positive torque of the magnitude of around 10% had been obtained, which implied a substantial reduction of the dynamic losses. The apprehended negative effect from the increased leakage through the larger blow hole area was limited, due to the fact that at that time, around 30 years ago, the screw compressors were produced for dry compression in the working space and the speed was substantially higher than that used at present for liquid-injected screw compressors. The increased leakage through the blow hole area was hereby percentagewise limited thanks to the higher speed. The afore-described causation with the influence from the female rotor torque had, however, not been realized at that time.

In connection with the development of screw compressors with oil injection which had started at the end of the Fifties the rotor profiles had to meet new requirements and as a consequence the asymmetrically line-generated profile was introduced shown for example in the U.S. Pat. No. 3,423,017. The most essential advantages of this new profile were, that the blow hole area was reduced by about 75% compared to the symmetrically circular profile, and that the sealing conditions on the drive side could be improved owing to the introduction of the so-called line-generated profile flank. In addition, the so-called trapped pockets at the rotor end faces were reduced in size and also could be drained more efficiently. At the low tip speeds of the rotors which had to be used due to the injection of oil directly into the compression space this new profile design proved to imply a substantial improvement in efficiency in comparison with earlier profile designs. However, the great influence on the compressor performance from the female rotor torque was still not realized. This torque had in fact practically the same value as for the aforesaid symmetrically circular profile viz round 10%. Moreover, the torque was negative at certain angular positions of the rotors whereby large dynamical losses of the kind referred to above were still obtained.

On the basis of an extensive study of the profile designs described above and also of more or less unsuccesful variants thereof developed in recent years in different countries, we were able to find the important factors, essential for optimizing the rotor profile in screw compressors. At this study, in addition to theroretical calculations, a great number of test results with screw compressors operating with the aforesaid different profile designs were evaluated. We could hereby conclude that the relation between the female rotor torque and the blow hole area had a vital importance for the adiabatic efficiency.

A negative female rotor torque, as already mentioned, implies that too large extra losses are obtained in the compressor. This can be illustrated as follows. In order to bring about this negative torque, a corresponding extra compression torque must be supplied to the compressor, which extra torque is transferred by the gas forces to the female rotor. A great part of this extra compression work is thereafter received in return, in that the negative torque is transferred via direct contact back to the male rotor. However, in connection with the thermodynamic transfer of the extra compression work to the female rotor and its subsequent mechanical return to the male rotor, apparently double losses are obtained, viz. by dynamic losses from the extra compression work and by gear losses at the transfer of torque from the female rotor back to the male rotor. As this extra compression work is carried out by so-called full-pressure compression having an adiabatic efficiency of only 40–50% and consequently substantially lower than at the normal compression process in the compressor, large thermodynamic losses arise in connection with the pressure of such a negative female rotor torque. It also was found at tests, that these losses strongly increase with increasing tip speed of the rotors. This agrees with what can be derived from theoretical calculations. Such thermodynamic losses, namely, theoretically increase in proportion to the third power of the speed. In order to achieve a high efficiency for screw compressors, it is, thus, essential that the rotor profile is designed so that a clearly positive female rotor torque is obtained. A further requirement is, that this torque remains positive for any angular position of the rotors. This requirement is not only important from an efficiency point of view, it also has proved to apply from an entirely different aspect, viz. to prevent a special type of vibration phenomenon to occur in the compressor, which phenomenon has proved to cause substantial rotor wear and in many cases also breakdown of the compressor. This vibration phenomenon occurs with the female rotor and consists of angular vibrations, i.e. the female rotor vibrates in its angular space, the so-called backlash space in the rotor mesh. These vibrations are initiated by pressure pulsations in the compressor discharge port and to some extent also by impulses from non-uniform contact conditions in the rotor mesh. It was found by extensive investigations that, in order to ensure that such vibrations will not arise even under the most unfavourable conditions in respect of said pressure impulses and mesh contacts, the rotor profile must be designed to give a certain minimum torque to the female rotor. This minimum torque, which amounts to about 18% of the corresponding male rotor torque has been found by theoretical calculations and by experience from tests during many years. On the other hand it is necessary to limit the female rotor torque partly in order to keep the contact forces between the rotors as small as possible from wearing viewpoint perhaps primarily because an increasing female rotor torque automatically also means an increasing blow hole area. It was, finally, found that an optimum rotor profile must be designed so that the female rotor torque amounts to between 17 and 19.5%, or preferably 18.5% of the corresponding male rotor torque. In FIG. 6 is shown for two different profile designs how the torque T for the male and female rotors varies as a function of the turning angle of the male rotor. The two upper curves show how the male rotor torque varies, and the lower curves show the corresponding variation for the female rotor.

The dashed curves indicate the torque variation for a reference profile designated as profile No 2 (shown in FIG. 7) while the continuous curves indicate the torque variation for the optimum profile design, profile No 1, according to this invention (shown in FIG. 7). As the number of lobes of the male rotor is 4, the cyclic torque variation has a period corresponding to 90 degrees turning angle of the male rotor. The absolute torque is for the respective rotor represented by the area between torque variation curve and the horizontal axis (abscissa) in the diagram. The torque calculated in this way for the male rotor is designated $T_M$, and the corresponding torque for the female rotor is designated $T_F$. For profile No 2 the ratio between the female rotor torque and the male rotor torque is negative and equal to −5.7%. As appears from FIG. 6, this profile has an additional disadvantage, in that the female rotor torque is negative during a large part (about 1/3) of the aforesaid period of 90 degrees and, besides, that the torque momentarily amounts to a very high negative value. It was also found at the evaluation tests run with rotors manufactured according to this profile, that the adiabatic efficiency was remarkably low, especially at higher rotor tip speeds. For the optimum profile design (profile No 1) the female rotor torque, as evident from FIG. 6, is positive during the entire 90 degree period. Calculated in the way stated above, thus, a positive value amounting to 18.7% is obtained. Compared to profile No 2, thus, the female rotor torque has been increased from −5.7% to +18.7%. At the same time a relatively much more uniform torque variation was obtained. This altogether resulted in a substantial improvement of the efficiency. In FIG. 7 the adiabatic efficiency is shown as a function of the tip speed of the male rotor obtained at entirely comparable tests with the two profiles 1 and 2. It appears from this figure that a substantial improvement was obtained for the optimum profile (7% improvement at the normal tip speed of about 25 m/s) and at increasing tip speed a still larger improvement was obtained (11% at a tip speed of 40 m/s).

In order to obtain an optimum rotor profile from an adiabatic efficiency aspect, its design must be such that, at the aforesaid conditions as regards the female rotor torque, the smallest possible blow hole area calculated per pair of thread volume is obtained. According to a calculation method generally established in screw compressor technology, comparative calculations of blow hole areas for a rotor diameter of 100 mm, a rotor length of 150 mm and wrap angle of the male rotor of 300° are used as reference dimensions. The relative blow hole area is expressed in $mm^2$ area per liter volume for one pair of full thread volumes formed by two co-operating male and female rotor grooves. It was found that, for obtaining the aforesaid optimum female rotor torque for a profile, which also in other respects is optimally designed, the smallest possible below hole area is of the magnitude 20 to 25 $mm^2$/liter, or preferably about 23 $mm^2$/liter.

In order to meet the aforesaid requirements for an optimum rotor profile, we have found at our calculations that the profile preferably should be designed in the way that will be described in the following.

As to the number of lobes for the male and female rotors, different proposals have been made in patent applications and publications. The lobe number, which is most essential for the performance of the screw compressor, is referred to the male rotor and we have found that 4 lobes is a prerequisite of obtaining the optimum rotor profile according to this invention. By this number of lobes it is possible, at the primary requirements stated above to obtain also the largest possible displacement at the same time as the rotors from a strength point of view will resist the stresses, to which they are subjected even at the roughest operation conditions. As to the female rotor it was found, that above all from a strength and manufacturing point of view the optimum lobe number is 6.

The profile flanks for the rotors for this optimum lobe combination 4+6 for the stated requirements can be designed in different ways. The following embodiment describes one example of how these profile flanks can in detail be designed.

The aforesaid object of producing a rotor profile with optimum adiabatic efficiency is achieved in that the invention has been given the characterizing features defined in the attached claims.

The invention is described in the following by way of an embodiment shown in the accompanying drawings, in which FIG. 1 is a cross-section through a pair of rotors according to the invention perpendicular to the rotor axes and with the rotors in the angular position corresponding to so-called full mesh, i.e. when the radially innermost point of the female rotor groove co-operates with the radially outermost point of the corresponding male rotor land, FIG. 2 shows in an enlarged scale the male rotor land co-operating with the female rotor groove in the same angular position as in FIG. 1.

Figure 6:
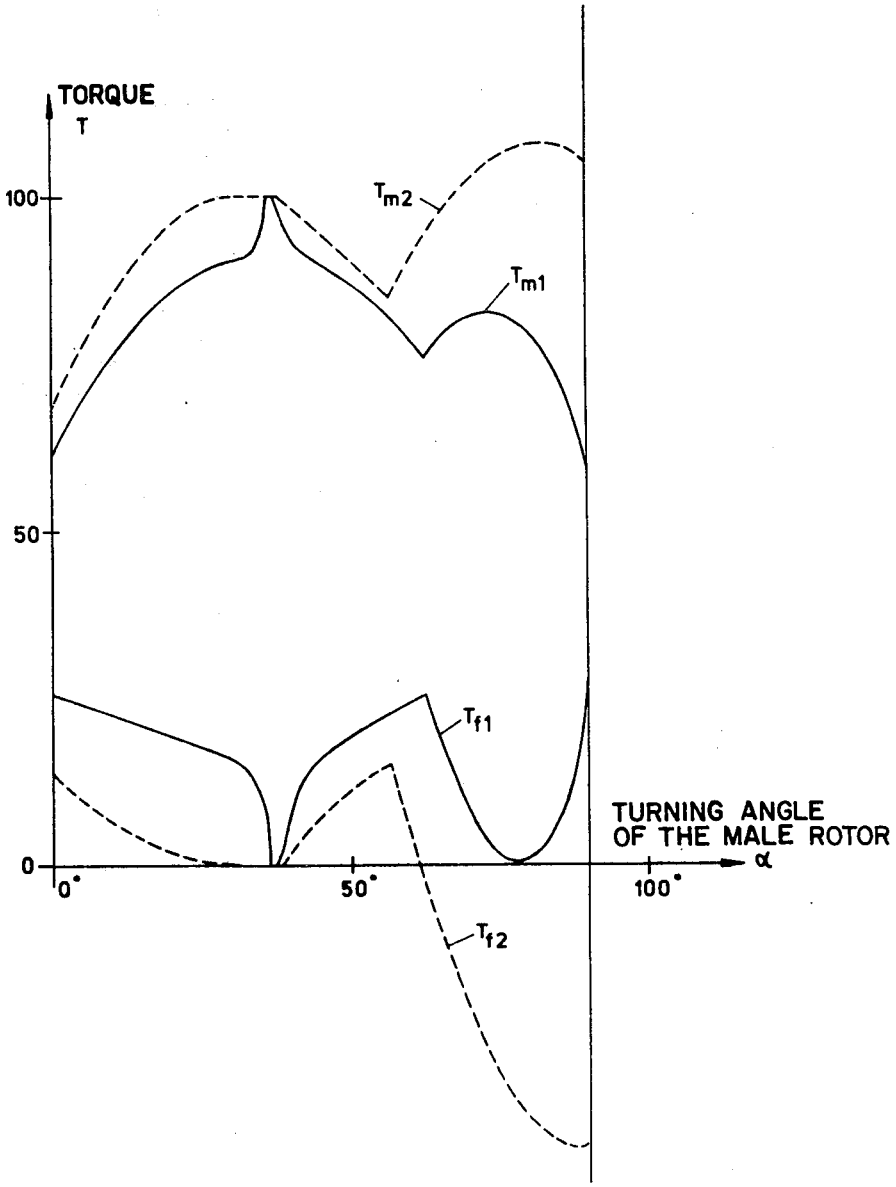
Figure 7:
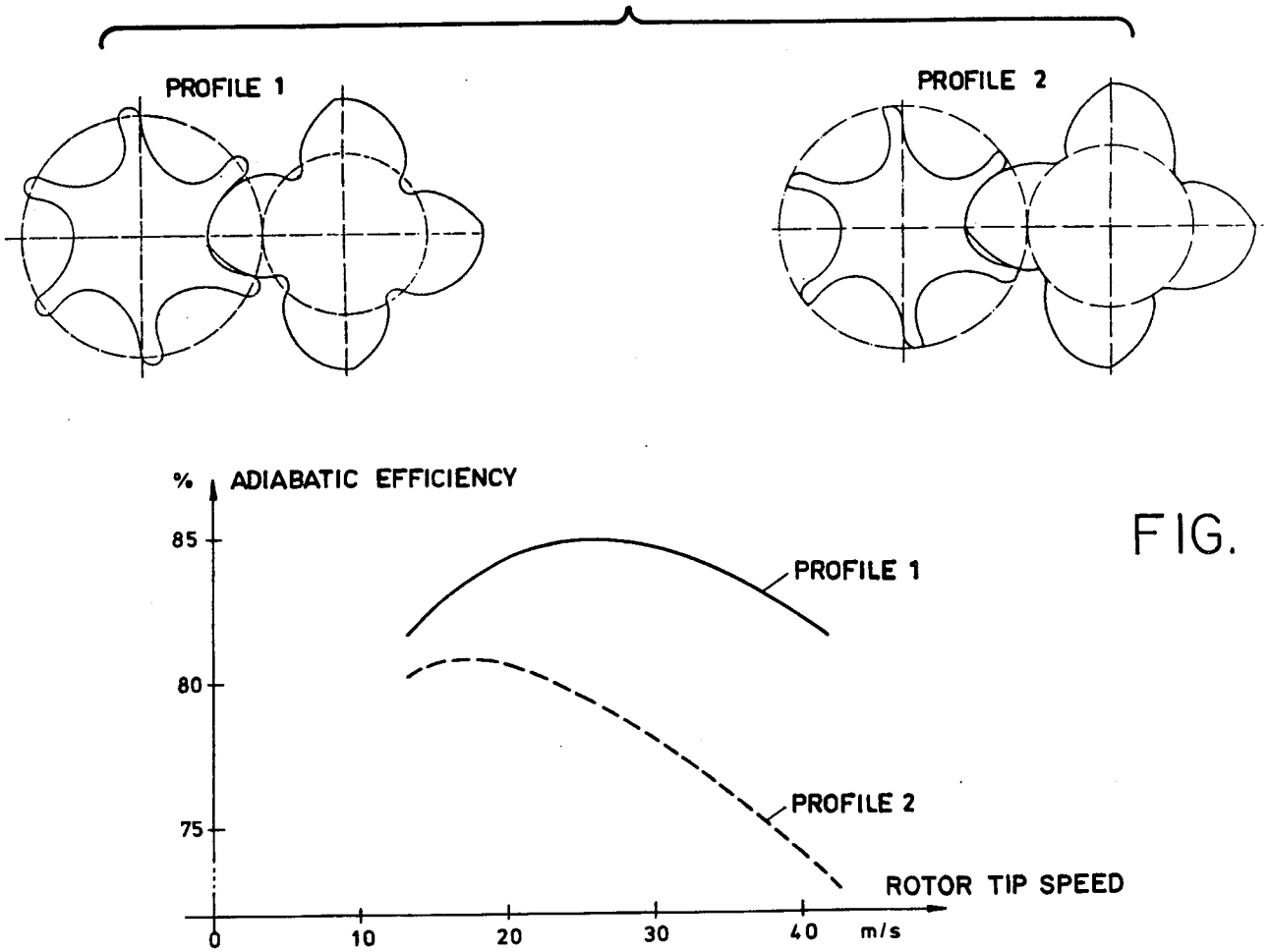

FIG. 6 shows the torque variation of the male and female rotors as a function of the turning angle of the male rotor for rotors having a profile according to the invention (continuous line) and for rotors having a reference profile (dashed line), and FIG. 7 shows the profile for the rotors according to the invention (profile 1) and the reference profile (profile 2) and a diagram illustrating the adiabatic efficiency as a function of the tip speed of the male rotor for these two rotor profiles obtained at entirely comparable tests.

Figure 1:
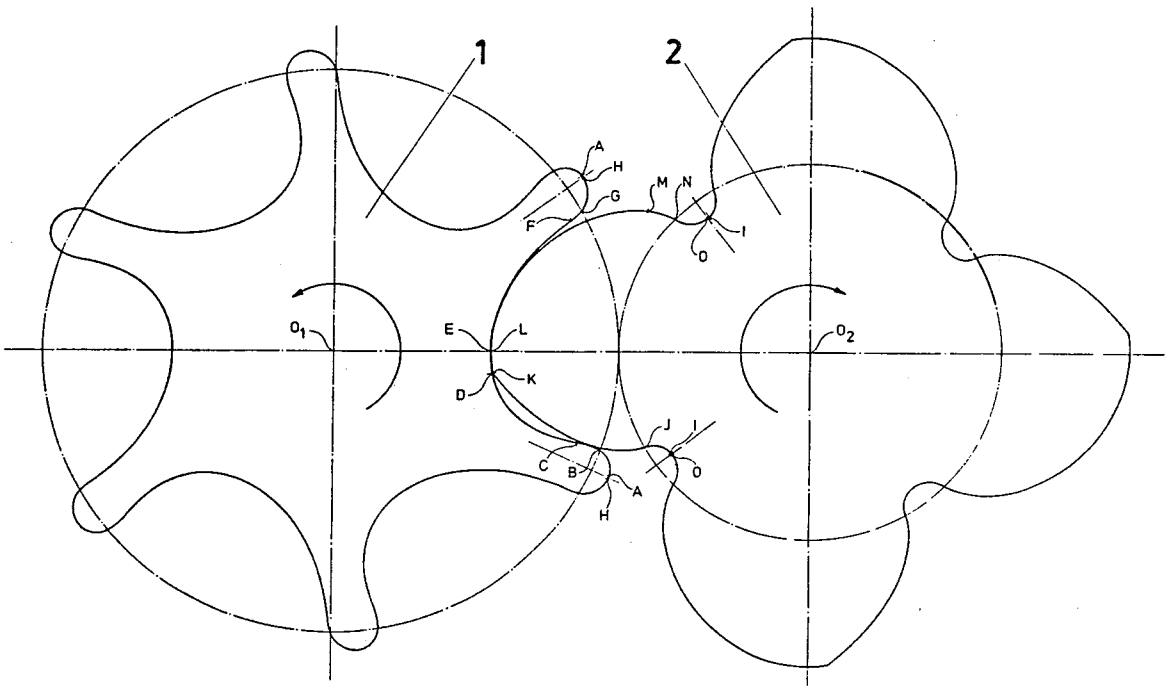

As evident from FIG. 1, the rotors according to this embodiment have the lobe combination 4+6, which indicates that the male rotor has 4 lobes and the female rotor 6 lobes. The intervening spaces between the lobes are called rotor grooves or only grooves. The characterizing portion of the male rotor is the land of the rotor, and the characterizing portion of the female rotor is the groove. Hereinafter, therefore, lands will be mentioned in respect of the male rotor, and grooves in respect of the female rotor. Each land and each groove has two flanks. The first land flank in the direction of rotation is called the leading flank of the male rotor, and the second land flank in the direction of rotation is called the trailing flank of the male rotor. In a corresponding manner, the first groove flank in the direction of rotation of the female rotor is called the leading flank, and the second groove flank of the female rotor is called the trailing flank. The land flanks of the male rotor co-operate with the groove flanks of the female rotor.

Each flank is split up into a number of portions with different geometry. The flank portions of each land of the male rotor are the same and consequently the flank portions of each groove of the female rotor are also the same. In order to facilitate the description, each flank portion is described individually, starting with the trailing groove flank of the female rotor. In the following description, the female rotor is designated by 1, and the male rotor is designated by 2. Accordingly, for the corresponding points and lines of the two rotors index 1 is used for the female rotor, and index 2 is used for the male rotor.

E-D

Figure 2:
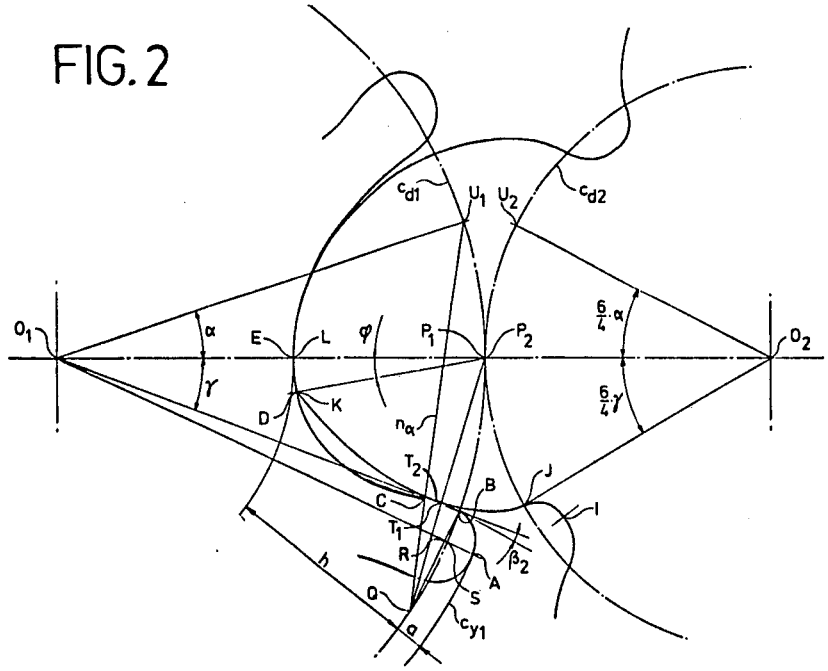

The flank portion E-D shown in FIG. 2 on the groove flank of the female rotor follows a circular arc with the centre in a point $P_1$, which coincides with the point constituting the intersection point between the pitch circle $c_{d1}$ of the female rotor and the straight line extending through the centre $0_1$ of the female rotor and the point E, which is one delimiting point of this flank portion. The point E is also the point in the rotor groove which is located closest to the centre $0_1$ of the female rotor, i.e. it is the innermost point of the groove. The centre $P_1$ of the arc is also the point, which is the tangential point of the pitch circle $c_{d1}$ with the pitch circle $c_{d2}$ of the male rotor when the rotors fully mesh. The radius of the arc E-D corresponds to the radial depth h of the female rotor groove inside the pitch circle. h designates usually the lobe depth, which at the embodiment shown is 20% of the outer diameter of the co-operating male rotor. In practice, however, the radius for the arc E-D is dimensioned slightly larger than the depth h in order to ensure a certain clearance between the two rotors when meshing. The extent of the arc E-D is determined by the angle $\phi$, which at the embodiment shown is 10°. The arc E-D hereinafter is called the first trailing groove flank portion of the female rotor.

D-C

Figure 3:
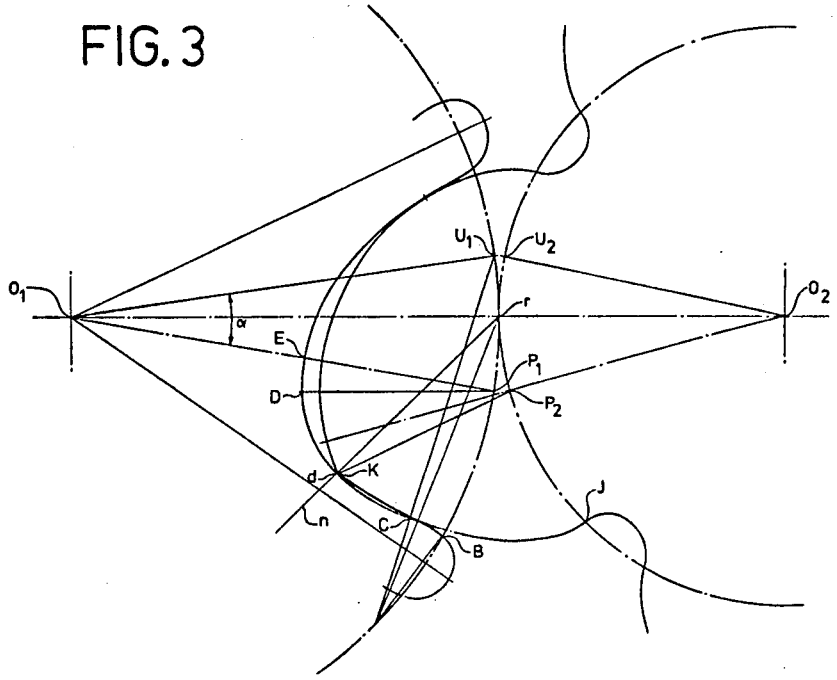
FIG. 3 is a view similar to that shown in FIG. 2 but with the rotors in another angular position.

The flank portion D-C is called the second trailing groove flank portion of the female rotor. In FIGS. 2 and 3 is shown how this portion is formed. This groove flank portion is an epitrochoid, which is generated by a point K (described in detail below) on the male rotor land flank. FIG. 2 shows a thread pair in the angular position corresponding to full mesh. In FIG. 3 the same thread pair is shown in a different angular position. The rotors here have been turned against the rotation direction a certain angle ($\sim 12°$ for the female rotor and $\sim 12\times(6/4)=18°$ for the male rotor). At this turning the point K has described the epitrochoid curve D-d. The normal n to the epitrochoid in the generating point d extends through the rolling point r of the pitch circles. (This is a basic property in the theory of gearing. The two co-operating gear profiles shall have a common tangent in the contact point where the normal to the profiles shall extend through the rolling point. The pitch circles roll on each other without sliding). In practice the groove flank portion D-C is moved slightly outwards in the direction of the normal in order to obtain a certain clearance in the mesh. At the emodiment shown, the generation of the groove flank portion D-C is ended in the point C, corresponding to a turning of the female rotor equal to an angle $\alpha \approx 18°$ from the starting position shown in FIG. 2. In the point D where the groove flank portions E-D and D-C meet each other the two flank curves have a common tangent.

C-B

The flank portion C-B, FIGS. 2 and 3, is a circular arc joining the flank portion D-C at point C, so that the two flank curves there have a common tangent. The flank portion C-B is called the third trailing groove flank portion of the female rotor. The centre Q for the arc C-B is located on the normal $n_\alpha$. The size of the radius can be varied and affects, among others, the size of the angle $\beta_2$ (see FIG. 2). The outer terminal point B of the arc C-B is located at the pitch circle $c_{d1}$ of the female rotor. $\beta_2$ is the angle between the tangent of the arc C-B in point B and the diameter of the pitch circle $c_{d1}$ through the point B. From a manufacturing aspect it is favourable to have a large value of the angle $\beta_2$ which is desirable also from another point of view, viz. that the torque distribution between the rotors will be more uniform, i.e. an increasing torque of the female rotor is obtained, which is desired both for improving the adiabatic efficiency and for increasing the mechanical reliability of the screw machine (less risk for vibration problems with the female rotor). An increased value of the angle $\beta_2$ also implies a disadvantage in that the area for gas leakage from thread to thread is increased, i.e. the so-called blow hole area is increased. By designing the leading groove flank in a suitable manner, as later will be described, the angle $\beta_2$ can be dimensioned relatively moderately without thereby obtaining a too unfavourable torque distribution between female and male rotors. In the embodiment shown the radius of the arc C-B has been chosen so that the centre Q of the arc coincides with the intersection point between the aforementioned normal $n_\alpha$ and the pitch circle $c_{d1}$. The angle $\beta_2$ is then $\approx 7.2°$.

B-A

The flank portion B-A in FIGS. 2 and 3 also is a circular arc, and it is called the fourth trailing groove flank portion of the female rotor. The portion of the rotor profile which is located outside the pitch circle $c_{d1}$ of the female rotor, is usually called the addendum and its radial extent as for the thread depth h, is usually expressed in percent of the outer diameter of the male rotor. The centre R of the flank portion B-A is located on the line B-Q, i.e. at the radius of the arc C-B to the point B, in order to prevent corners at the joining point B between the third and fourth trailing groove flank portions. The size of the radius R-B is so dimensioned that the arc B-A in its radially outermost point A contacts the outer circle $c_{y1}$ of the female rotor. In the embodiment shown, the addendum a is round 3% of the outer diameter of the male rotor. Also the groove flank portion B-A, like the groove flank portion C-B, is corrected in practice so that a constant or varying clearance is obtained.

L-K

The flank portion L-K, FIG. 2, is the first trailing land flank portion of the male rotor and corresponds to the first trailing groove flank portion E-D of the female rotor. The flank portion L-K, like the groove flank portion E-D, follows a circular arc, the centre $P_2$ of which coincides with the intersecting point between the pitch circle $c_{d2}$ of the male rotor and the straight line extending through the centre $0_2$ of the male rotor and the point L of the flank portion L-K which is the outermost point of the male rotor land. The distance $0_2$-L, thus, is half the outer diameter of the male rotor. The centre $P_2$ of the arc L-K is the tangent point between the pitch circle $c_{d2}$ of the male rotor and the pitch circle $c_{d1}$ of the female rotor when the rotors fully mesh. The centre $P_2$ then is also the tangent point to the centre $P_1$ for the first trailing groove flank portion E-D of the female rotor. While the radius for the arc E-D is slightly larger than the lobe depth h, the radius of the arc L-K is dimensioned equal to the lobe depth h. The extent of the arc L-K is determined, in the same way as for the arc E-D, viz. by the angle $\phi$.

K-J

The second trailing land flank portion K-J of the male rotor, FIGS. 2 and 3, is generated by the third trailing groove flank portion C-B of the female rotor. Contrary to the groove flank portion B-C, which is generated by a point (K) when the pitch circles roll on each other, the land flank portion K-J is generated by all the points on the arc C-B. The land flank portion K-J also can be said to be generated by a point, which is not fixed in relation to the pitch circle $c_{d1}$ of the female rotor, but during the generation moves along the arc C-B. Usual names for this type of generation of a flank profile are line generation or travelling generation. As appears from FIG. 2, the land flank portion K-J has been divided into K-$T_2$ and $T_2$-J. In a corressponding manner the arc C-B has been divided into C-$T_1$ and $T_1$-B. The portion K-$T_2$ is generated by the portion C-$T_1$. In the starting position (FIG. 2) when the rotors fully mesh, the points $P_1$ and $P_2$ coincide with the rolling point r. The point $T_2$ and the point $T_1$ in this position are in contact with each other. They always coincide in this position with the generated and the generating point and, besides, are located on the straight line $P_1$-Q. When now the female rotor is turned clockwise (against the direction of rotation) so that the rolling point moves from $P_1$ to $U_1$ and from $P_2$ to $U_2$, respectively, then the generating point on the arc C-B moves from $T_1$ to C, whereby the land flank portion $T_2$-K is generated. After having turned the female rotor an angle $\alpha$ the generation of this portion is completed. The point C then coincides with the point K and the point $U_1$ with $U_2$. When, instead, the rotors are turned so that the female rotor rotates counterclockwise, the land flank portion $T_2$-J is in a corresponding way generated by the arc $T_1$-B. When the generation of this portion is completed, the female rotor has turned the angle $\gamma$, and the points B and J then coincide with the rolling point. Contrary to all other points along the flanks, the land flank portions L-K and K-J have no common tangent in the point K. In other words this point K is a corner on the male rotor land flank.

J-I

The third trailing land flank portion J-I of the male rotor, like the second trailing land flank portion K-J of the male rotor, is line generated by a curve on the trailing groove flank of the female rotor, viz. the arc B-A. The generation takes place in the same way as described for the flank portion K-J. The turning of the rotors, during which the generation of the third trailing land flank portion J-I of the male rotor takes place, is determined by the extension of the arc B-S on the pitch circle $c_{d1}$ of the female rotor (FIG. 2).

E-F

Figure 4:
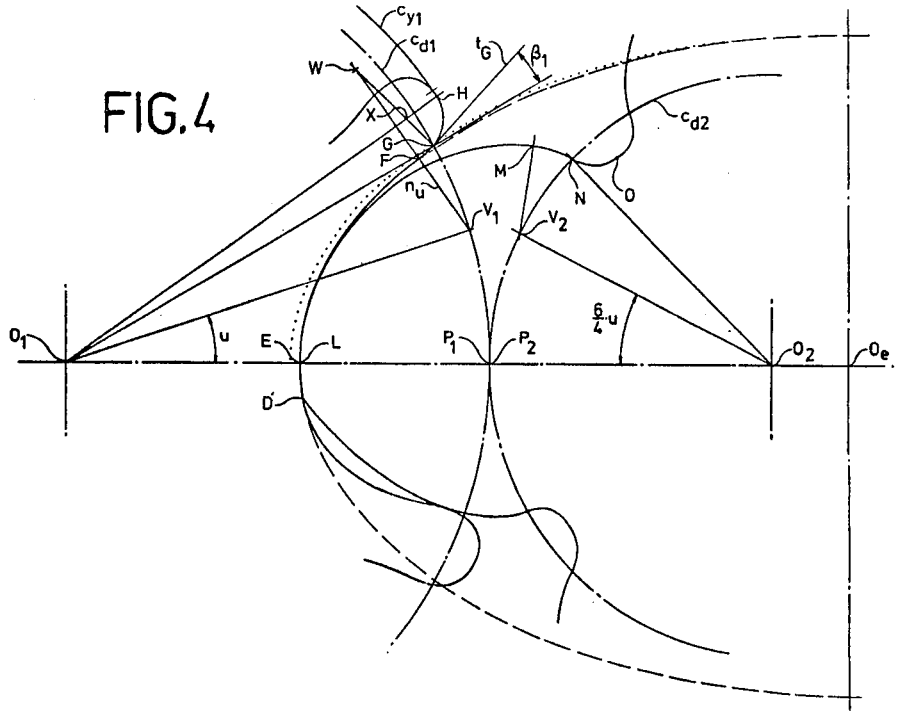
FIG. 4 is a view similar to that shown in FIG. 2 but for explaining the other flank side of the female rotor groove and the male rotor land.
Figure 5:
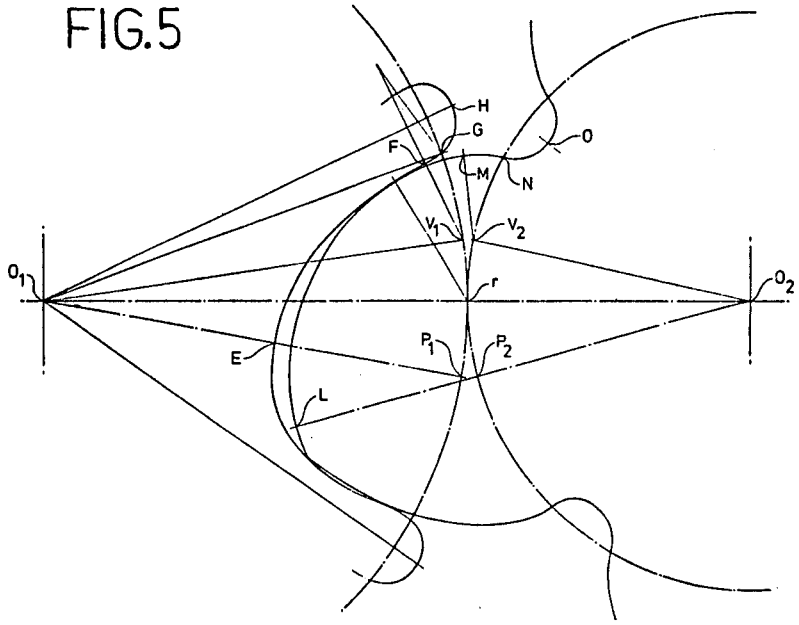
FIG. 5 is a vew similar to that in FIG. 3 but for explaining the other flank side of the female rotor groove and the male rotor land.

The first leading groove flank portion E-F of the female rotor proceeds from the innermost point E of the rotor groove and follows an elliptic arc, FIGS. 4 and 5. The centre $0_e$ of the ellipse is located on the extension of the straight line $0_1$-E-$P_1$, and the distance E-$O_e$ thus is half the major axis of the ellipse. The length of the major axis E-$O_e$ and the ratio between the major axis and the minor axis can be chosen relatively freely. However, in order to obtain a flank profile, which meets the demands according to the invention, the major axis must be larger than the outer diameter of the male rotor. Thus, the distance E-$O_e \geqq$ distance L-$O_2$, and the ratio between the major axis and the minor axis must be in the range of 1.5:1 to 2.0:1 for the lobe combination 4+6. The flank portion E-F is generating the corresponding flank portion L-M on the male rotor during the turning angle u (arc $P_1$-$V_1$) of the female rotor. Of course, the converse is also true that the flank portion E-F is line generated by the flank portion L-M. The straight line F-$V_1$ is the normal $n_u$ to the ellipse in the point F. By choosing an ellipse in this way, the leading and trailing groove flanks of the female rotor will get a common tangent in the point E. Moreover, the elliptic configuration of the flank portion E-F can be utilized for achieving an interlobe clearance which will continuously decrease from the point E to the point F by means of increasing the length of the major axis of the ellipse in order to obtain a modified flank profile (dotted line in FIG. 4). By changing also the length of the minor axis, the clearance distribution along the flank portion E-F can be further modified. By variation of these two axes it is consequently possible in a simple way to attain the desired clearance distribution along the flank. At the embodiment shown, the angle $u \approx 18°$, the ratio between the major axis and the minor axis of the ellipse $\approx$1.70:1 and the length of the major axis has been choosen so that the radius of curvature of the ellipse in the point E is the same as the radius for the arc E-D.

F-G

The second leading groove flank portion F-G of the female rotor, FIG. 4, follows a circular acr with its centre in a point W inside the pitch circle $c_{d1}$ of the female rotor. The outermost point G of the flank portion F-G is located at the pitch circle $c_{d1}$ of the female rotor. The radius for the flank portion F-G at the embodiment shown has been chosen equal to the radius for the arc C-B on the trailing groove flank of the female rotor.

G-H

Also the third leading groove flank portion G-H of the female rotor, FIG. 4, follows a circular arc with its centre located in a point X on the line W-G in order to give the two flank portions F-G and G-H a common tangent $t_G$ in their meeting point G. The angle between the tangent $t_G$ and the straight line through the centre $0_1$ of the female rotor and the point G is $\beta_1$. The design, thus, is the same as for the flank portions C-B and B-A on the trailing groove flank of the female rotor. As the radius of the arc F-G at the embodiment shown has been chosen equal to the radius for the arc C-B, the angle $\beta_1 \approx 17.3°$. The radius X-G is so dimensioned that the arc G-H and the outer circle $c_{y1}$ of the female rotor contact each other in the point H.

L-M

The first leading land flank portion L-M of the male rotor is line generated by the elliptic arc E-F on the leading groove flank of the female rotor in principally the same way as for the second trailing land flank portion K-J of the male rotor. When the rotors are turned from the full mesh position, where the points $P_1$ and $P_2$ on the female rotor and male rotor contact each other in the rolling point r, against the direction of rotation the arc $P_1$-$V_1$ on the pitch circle $c_{d1}$ of the female rotor and the arc $P_2$-$V_2$ on the pitch circle $c_{d2}$ of the male rotor will roll on each other (see FIG. 5). The generating point then moves from the point E to the point F on the groove flank of the female rotor and simultaneously from the point L to the point M on the corresponding land flank of the male rotor.

M-N

The second leading land flank portion M-N of the male rotor is line generated by the corresponding portion F-G of the groove flank of the female rotor. The innermost point N of the land flank portion M-N is located at the pitch circle $c_{d2}$ of the male rotor. The profile of this flank portion is consequently built up in pricipally the same way as the opposite curve portion of the trailing land flank of the male rotor.

N-O

The third leading land flank portion N-O of the male rotor is line generated by the corresponding flank portion G-H of the leading groove flank of the female rotor. This land flank portion N-O of the male rotor is located inside the pitch circle $c_{d2}$ of the male rotor.

H-A

The outermost portion H-A of the female rotor is located on the outer circle $c_{y1}$ of the female rotor and connects two consecutive grooves of the female rotor, FIG. 1.

O-I

The innermost portion O-I of the male rotor land is the portion, which connects two consecutive male rotor lands and is line generated by the outermost portion H-A of the female rotor.

What we claim is:

1. Two meshing rotors provided with helical lands and intervening grooves and adapted for rotation around parallel axes in a working space in a rotary screw machine, where one groove of one rotor cooperates with a corresponding land of the second rotor so that a chevron shaped chamber is formed, the open end of which opens to the high pressure end of the machine, of which rotors one is of female rotor type and so designed that a major portion of each groove flank is located inside the pitch circle of the rotor and a minor portion is located outside the same, and the second rotor is of male rotor type and so designed that a major portion of each land flank is located outside the pitch circle of the rotor and a minor portion is located inside the same, and in a plane perpendicular to the rotor axes, the substantial part of a trailing flank of each female rotor groove forming the peripherally outer wall of said chevron shaped chamber has a profile which is generated by a corner on the male rotor flank, and a leading flank of each female rotor groove forming the peripherally inner wall of said chevron shaped chamber has a profile which substantially is line-generated by a flank profile of the male rotor, and the flank profiles of each male rotor land follow the envelopes formed by corresponding profiles on the female rotor flank when the lands and grooves move into and out of mesh with each other, characterized in that the profiles are so formed that the torque acting on the female rotor by the gas forces in the machine is 17–19.5%, of the corresponding torque on the male rotor, and that the blow hole area formed at the high pressure side of the rotor mesh does not exceed a value corresponding to 25 $mm^2$ per liter volume of the chevron shaped chamber when this chamber has its maximum volume, calculated for a male rotor diameter of 100 mm, a rotor length of 150 mm and a wrap angle of the male rotor of 300°.

2. Rotors as defined in claim 1, characterized in that said leading groove flank of the female rotor comprises a first flank portion, which follows an elliptic curve and that the corresponding first flank portion of the leading land flank of the male rotor is line-generated by said elliptic curve.

3. Rotors as defined in claim 2, characterized in that said elliptic groove flank portion of the female rotor extends from the radially innermost point of the groove outwards to a point adjacent to and inside the pitch circle of the female rotor.

4. Rotors as defined in claim 2, characterized in that said elliptic flank portion of the female rotor groove is a part of an ellipse which has a centre located on a line extending through the centres of the two rotors when the rotors are fully meshing with each other.

5. Rotors as defined in claim 4, characterized in that the major axis of said ellipse is larger than or equal to the outer diameter of the male rotor.

6. Rotors as defined in claim 4, characterized in that the ratio between the major axis and minor axis of said ellipse is in the range of 1.5:1 to 2:1.

7. Rotors as defined in claim 4, characterized in that the ellipse used for forming said first flank portion of the female rotor groove has a larger major axis but the same minor axis and centre as the ellipse used for generation said corresponding flank portion of the male rotor.

8. Rotors as defined in claim 1, characterized in that the ellipse used for forming said first flank portion of the female rotor groove has a slightly deviating minor axis but the same major axis and centre as the ellipse used for generating said corresponding flank portion of the male rotor.

9. Rotors as defined in claim 1, characterized in that the female rotor has six lands and grooves and the male rotor has four lands and grooves.

10. Rotors as defined in claim 9, characterized in that the radial extent of the female rotor grooves inside the pitch circle is 19–21%, preferably about 20%, of the outer diameter of the male rotor, and that the radial extent of the addendum located outside the pitch circle of the female rotor is 2.5–3.5%, preferably about 3%, of the outer diameter of the male rotor.

11. Rotors as defined in claim 1, characterized in that the trailing groove flank of the female rotor includes a first flank portion which follows a circular arc having its centre located at the tangent point of the pitch circles of the male and female rotors when the rotors are fully meshing with each other.

12. Rotors as defined in claim 11, characterized in that the trailing land flank of the male rotor includes a first flank portion which follows a circular arc having its centre located at the tangent point of the pitch circles of the male and female rotors when the rotors are fully meshing with each other.

13. Rotors as defined in claim 11, characterized in that said trailing groove flank of the female rotor includes a second flank portion generated by a point on the male rotor flank.

14. Rotors as defined in claim 16, characterized in that said point on said trailing land flank of the male rotor is the meeting point between said first and said second flank portions of said trailing land flank of the male rotor.

15. Rotors as defined in claim 14, characterized in that said meeting point is a sharp corner on said trailing land flank of the male rotor.

16. Rotors as defined in claim 13, characterized in that said trailing groove flank of the female rotor includes a third flank portion which follows a circular arc having its centre located so, that said second and third flank portions have a common tangent in their meeting point.

17. Rotors as defined in claim 16, characterized in that said trailing land flank of the male rotor includes a second flank portion, which is line-generated by said third flank portion of said trailing groove flank of the female rotor.

18. Rotors as defined in the claim 16, characterized in that the meeting point between said third and said fourth flank portions of said trailing groove flank of the female rotor is located at the pitch circle of the female rotor, and that the meeting point between said second and said third flank portions of said trailing land flank of the male rotor is located on the pitch circle of the male rotor.

19. Rotors as defined in claim 16, characterized in that said trailing groove flank of the female rotor includes a fourth flank portion, which follows a circular arc having its centre on the connecting line between the meeting point of said third and fourth flank portions and said centre of said third flank portion, and having a radius dimensioned so that said fourth flank portion in its radially outermost point contacts the outer circle of the female rotor.

20. Rotors as defined in claim 19, characterized in that said trailing land flank of the male rotor includes a third flank portion, which is line-generated by said fourth flank portion of said trailing groove flank of the female rotor.

21. Rotors as defined in claim 2, characterized in that the said leading land flank of the male rotor includes a second flank portion, which is line-generated by said second flank portion of the female rotor.

22. Rotors as defined in claim 2, characterized in that said first flank portions of said leading and trailing groove flanks of the female rotor have a common tangent in their meeting point.

23. Rotors as defined in claim 2, characterized in that the leading groove flank of the female rotor includes a second flank portion which follows a circular arc having its centre located so, that the first and the second leading groove flank portions have a common tangent in their meeting point.

24. Rotors as defined in the claim 23, characterized in that the meeting point between said second and said third flank portion of said leading groove flank of the female rotor is located at the pitch circle of the female rotor, and that the meeting point between said second and said third flank portion of said leading land flank of the male rotor is located at the pitch circle of the male rotor.

25. Rotors as defined in claim 23, characterized in that said leading groove flank of the female rotor has a third flank portion which follows a circular arc having a radius so dimensioned and a centre so positioned, that said second and third flank portions have a common tangent in their meeting point, and that the radially outermost point of said third flank portion contacts the outer circle of the female rotor.

26. Rotors as defined in claim 25, characterized in that said leading land flank of the male rotor includes a third flank portion, which is line-generated by said third leading groove flank portion of the female rotor.

* * * * *